US011512878B2

(12) United States Patent
Zajac et al.

(10) Patent No.: US 11,512,878 B2
(45) Date of Patent: Nov. 29, 2022

(54) EASILY DISMOUNTABLE HEAT PUMP AND METHOD OF MANUFACTURING A HEAT PUMP

(71) Applicant: Efficient Energy GmbH, Feldkirchen (DE)

(72) Inventors: Adrian Zajac, Munich (DE); Johannes Lang, Munich (DE); Bartosz Szyczewski, Munich (DE)

(73) Assignee: EFFICIENT ENERGY GMBH, Feldkirchen (DE)

( * ) Notice: Subject to any disclaimer, the term of this patent is extended or adjusted under 35 U.S.C. 154(b) by 310 days.

(21) Appl. No.: 16/830,490

(22) Filed: Mar. 26, 2020

(65) Prior Publication Data

US 2020/0309423 A1 Oct. 1, 2020

(30) Foreign Application Priority Data

Apr. 1, 2019 (DE) ..... 102019204595.2

(51) Int. Cl.
*F25B 30/02* (2006.01)
*F25B 31/02* (2006.01)
(Continued)

(52) U.S. Cl.
CPC ..... *F25B 30/02* (2013.01); *F04D 29/441* (2013.01); *F04D 29/624* (2013.01); *F25B 31/026* (2013.01); *F25B 2400/07* (2013.01)

(58) Field of Classification Search
CPC ..... F25B 31/02; F25B 1/04; F25B 2309/00; F25B 2400/07; F25B 30/02; F25B 31/026;
(Continued)

(56) References Cited

U.S. PATENT DOCUMENTS 1,934,604 A 11/1933 Kucher
4,946,351 A 8/1990 Richardson, Jr.
(Continued)

FOREIGN PATENT DOCUMENTS

CN 106194654 B 12/2016
CN 210509643 U 5/2020
(Continued)

OTHER PUBLICATIONS

British Office Action dated Aug. 4, 2020, issued in application No. GB2004301.4.

*Primary Examiner* — Aaron R Eastman
(74) *Attorney, Agent, or Firm* — McClure, Qualey & Rodack, LLP

(57) ABSTRACT

A heat pump includes a housing; a liquefier and an evaporator arranged inside the housing; and a compressor interposed between the evaporator and the liquefier in terms of fluid flow, the compressor having a motor, an impeller connected to the motor, and a diffusor, the diffusor having a diffusor portion extending between the motor and the impeller, the diffusor portion having at least two parts, a first part of the diffusor portion being connected to the housing and a second part of the diffusor portion being connected to the motor, wherein the first part of the diffusor portion has an opening, wherein the second part of the diffusor portion is configured to close the opening, and wherein the opening is dimensioned such that the impeller is removable from the housing through the opening.

19 Claims, 10 Drawing Sheets

(51) Int. Cl.
*F04D 29/44* (2006.01)
*F04D 29/62* (2006.01)

(58) Field of Classification Search
CPC ..... F04D 29/441; F04D 29/624; F04D 17/10;
F04D 25/0606; F04D 25/06
See application file for complete search history.

(56) References Cited

U.S. PATENT DOCUMENTS

| | | | |
|---|---|---|---|
| 2003/0059296 | A1 | 3/2003 | Sishtla |
| 2016/0084525 | A1 | 3/2016 | Rissler et al. |
| 2018/0363960 | A1 | 12/2018 | Kniffler et al. |

FOREIGN PATENT DOCUMENTS

| | | | |
|---|---|---|---|
| DE | 102016203414 | B4 | 9/2017 |
| EP | 1571343 | A1 | 9/2005 |

(top view of diffusor)

EASILY DISMOUNTABLE HEAT PUMP AND METHOD OF MANUFACTURING A HEAT PUMP

CROSS-REFERENCE TO RELATED APPLICATION

This application claims priority from German Patent Application No. DE 10 2019 204 595.2, which was filed on Apr. 1, 2019, and is incorporated herein in its entirety by reference.

The present invention relates to heat pumps and in particular to heat pumps with a compressor comprising a motor, an impeller and a diffusor.

BACKGROUND OF THE INVENTION

DE 10 2016 203 414 B4 reveals a heat pump with an evaporator for evaporating working fluid inside an evaporator chamber. The heat pump further comprises a condenser for liquefying evaporated working liquid inside a condenser chamber bounded by a condenser floor. The evaporator chamber is partly surrounded by the condenser chamber. The evaporator chamber is further separated from the condenser chamber by the condenser floor. In addition, the condenser floor is connected to an evaporator floor to define the evaporator chamber. Above the evaporator chamber a compressor is provided, which is configured to compress evaporated working liquid and to lead it into the condenser chamber as compressed vapor. The condenser chamber is demarcated to the outside by a condenser wall. The condenser wall is also attached to the evaporator bottom, as is the condenser floor. The condenser floor has a tapering cross-section from an inlet for the working liquid to be evaporated to an exhaust opening which is coupled to the compressor or motor. The evaporated working liquid, which is water, for example, is sucked off by a radial impeller of the motor and brought into the liquefier as compressed and heated vapor through a diffusor.

FIG. 8 shows a schematic diagram of the eChiller cooling unit as is manufactured and distributed by Efficient Energy GmbH. Two individual heat pumps 1001, 1002 are arranged in a rack 1000 and connected with each other by appropriate piping and other elements. A heat pump comprises a cylindrical housing 1003, which has a housing cover 1004, which is attached to the housing 1003 with individual screws 1005. On the housing cover 1004 there is a motor housing 1006 which has the compressor motor known as "CT turbo" arranged therein. In the known arrangement shown in FIG. 8, the upper housing cover 1004 is designed as a entirely removable unit comprising the motor housing 1006, the motor located therein, a diffusor and an impeller. In order to carry out repair and/or maintenance work on the compressor assembly as shown at the top left in FIG. 8, the entire compressor assembly may first be detached from the container 1003 by loosening the various screws 1005. Only then can the compressor be dismounted, e.g. for carrying out maintenance or repair work inside the compressor motor.

In the compressor assembly shown in FIG. 8, the entire compressor may be removed from the system if problems occur with the compressor motor or the impeller. In case of service, the entire compressor is typically replaced, even if a defect or problem exists only in the compressor motor or impeller wheel.

This replacement involves either two service technicians to lift the compressor, which weighs approximately 26 kg, out of the system. Alternatively, this can also be done while using a lifting device. Both the compressor and the lifting device are classified as bulky goods due to their considerable sizes and, in particular, their considerable weights, and therefore lead to increased logistics costs.

US 2016/0084525 A1 reveals a heat pump water heater with a mounting arrangement for coupling a compressor to a plate inside a housing of the heat pump water heater. The mounting arrangement comprises a post extending through a base of the compressor, and a fastener extending in the post through a support and a plate to connect the support and post to each other. A nut is further applied to the post to connect the post and the base of the compressor to each other.

U.S. Pat. No. 4,946,351 reveals a compressor mounting system of a vertically upright compressor. An apparatus for the compressor comprises a housing having a lower end, a motor-compressor unit disposed within the housing, and a resilient member disposed on the bottom of the housing to suppress noise and vibration emitted by the compressor.

U.S. Pat. No. 1,934,604 reveals a refrigeration device in which a coolant is vaporized, compressed and condensed. The motor and the compressor are arranged within a housing of the cooling device in such a way that these elements are at least partially cooled by a condensed coolant.

CN 106194654 reveals a structure for a compressor. The structure includes a flat underside. A through hole is also provided to accommodate a lower shell of a compressor. The through hole is located in the center of the flat plate of the compressor base.

SUMMARY

According to an embodiment, a heat pump may have: a housing; a liquefier and an evaporator arranged inside the housing; and a compressor disposed between the evaporator and the liquefier in terms of fluid flow, the compressor including a motor, an impeller connected to the motor, and a diffusor, wherein the diffusor includes a diffusor portion extending between the motor and the impeller, the diffusor portion including at least two parts, a first part of the diffusor portion being connected to the housing and a second part of the diffusor portion being connected to the motor, and wherein the first part of the diffusor portion has an opening, wherein the second part of the diffusor portion is configured to close the opening, and wherein the opening is dimensioned such that the impeller is removable from the housing through the opening.

According to another embodiment, a method of manufacturing a heat pump which may have a housing; a liquefier and an evaporator arranged inside the housing; a compressor interposed between the evaporator and the liquefier in terms of fluid flow, the compressor including a motor, an impeller connected to the motor, and a diffusor including a diffusor portion extending between the motor and the impeller may have the steps of: forming the diffusor portion into at least two parts; and connecting a first part of the diffusor portion to the housing and a second part of the diffusor portion to the motor, wherein the first part of the diffusor portion has an opening, wherein the second part of the diffusor portion is configured to close the opening, and wherein the opening is dimensioned such that the impeller is removable from the housing through the opening.

According to another embodiment, a method of disassembling or assembling a heat pump including a housing; a liquefier and an evaporator disposed inside the housing; a compressor interposed between the evaporator and the liquefier in terms of fluid flow, the compressor including a motor, an impeller connected to the motor, and a diffusor, the diffusor including a diffusor portion extending between the motor and the impeller, wherein the diffusor portion includes at least two parts, a first part of the diffusor portion being connected to the housing and a second part of the diffusor portion being connected to the motor, and wherein the first part of the diffusor portion has an opening, and wherein the second part of the diffusor portion is configured to close the opening; including the steps of: opening the housing; detaching the first part of the diffusor portion from the second part of the diffusor portion; and removing the impeller through the opening in the first part of the diffusor portion, the impeller being attached to the second part of the diffusor portion, and the second part of the diffusor portion being attached to the motor; and removing the motor, the second part of the diffusor portion and the impeller from the housing; or inserting the impeller through the opening, the impeller being attached to the second part of the diffusor portion, and the second part of the diffusor portion being attached to the motor; attaching the first part of the diffusor portion to the second part of the diffusor portion; and closing the housing, the motor being housed inside the housing.

The present invention is based on the finding that a more efficient mountability and dismountability of a heat pump is achieved by configuring a diffusor portion, which extends between the compressor motor and the impeller, in at least two parts, a first part of the diffusor portion being connected to the housing of the heat pump and a second part of the diffusor portion being connected to the motor. The fact that the first part of the diffusor portion has an opening which is dimensioned in such a way that the impeller can be removed from the housing through this opening means that only a minimum number of elements have to be dismounted and removed for maintenance or repair work on the compressor motor and can be reinstalled, i.e. mounted. A particular advantage is that this minimum number of elements have a weight that can easily be handled by a single service person. In addition, the weight, which is typically less than 20 kg and advantageously even less than 15 kg, is such that the logistics costs in terms of bulky goods declarations etc. are also significantly lower than they have been previously.

A heat pump in accordance with the invention comprises a housing, a liquefier and an evaporator, both located inside the housing, and a compressor arranged between the liquefier and the evaporator in terms of fluid flow, this compressor comprising a motor, an impeller connected to the motor, and a diffusor. The diffusor comprises a diffusor portion extending between the motor and the impeller, and this diffusor portion is configured in at least two parts, such that the first part of the diffusor portion is connected to the housing and the second part of the diffusor portion is connected to the motor.

In certain embodiments, the compressor further comprises a suction mouth connected to the diffusor and arranged to suck gaseous fluid from the evaporator due to rotation of the impeller, and to direct it to the diffusor. The diffusor is further configured to direct compressed gaseous fluid into the liquefier.

A diffusor is generally configured to slow down a gas flow to increase the pressure within the gas. In other words, the kinetic energy introduced by the impeller into the gaseous working fluid, which is advantageously water vapor, is converted to thermal energy, i.e. to an increase in pressure. This is achieved by the diffusor providing an increasing cross-section for the gas flowing through the diffusor. At the outlet of the diffusor, the gas will then be high in pressure and, thus, high in temperature and will be fed to the liquefier.

In advantageous embodiments of the present invention, a mechanical decoupling means is provided in order to, depending on the implementation, vibrationally decouple the motor from the second part of the diffusor portion connected to the motor. Alternatively or additionally, the first part of the diffusor portion and the second part of the diffusor portion are vibrationally decoupled from each other by the mechanical decoupling means. Yet alternatively, the entire diffusor portion is vibrationally decoupled from the heat pump housing by a mechanical decoupling means. If the mechanical decoupling means is present between the motor and the second part of the diffusor portion, only the motor will vibrate, while the second part of the diffusor portion and the first part of the diffusor portion will vibrate less or not at all. If, on the other hand, the mechanical decoupling means is present between the first part of the diffusor portion and the second part of the diffusor portion, the motor will vibrate together with the (smaller) second part of the diffusor portion, while the first part of the diffusor portion will be rigid, i.e. will no longer vibrate, and can therefore be rigidly connected to the housing without causing the housing to vibrate undesirably.

Yet alternatively, the first part of the diffusor portion between the motor and the impeller and the second part of the diffusor portion between the motor and the impeller can be detachably but rigidly connected to each other. Then the mechanical decoupling means will be located between the first part of the diffusor portion and the housing, in such a way that the entire diffusor portion and, if need be, the entire diffusor vibrates with the motor, but these vibrations are not transmitted to the housing, or are transmitted to a greatly reduced extent only.

Advantageously the interface between the first part of the diffusor portion and the second part of the diffusor portion is provided with a separate seal. This seal is formed, for example, from one or more O-rings. One implementation of this seal is, for example, that an interface of the second part of the diffusor portion, which is connected to the motor, or of the first part has a groove into which an O-ring is inserted, while the interface of the first part of the diffusor portion, i.e. the opening line through which the impeller can be removed, or the corresponding other part, is provided with a flat surface which engages with the O-ring to achieve a seal. Alternative sealing implementations may also be performed with specific sealing elements or structures to seal the first part of the diffusor portion and the second part of the diffusor portion with each other in such a way that no working vapor sucked in through the suction mouth can escape between the first and second parts of the diffusor portion. These are, for example, implementation of a tongue and of two O-rings arranged above and below the tongue, etc.

The connection between the first part and the second part of the diffusor portion can be made directly or indirectly, depending on the implementation. An indirect connection consists in that the first part of the diffusor portion and the second part of the diffusor portion are sealed together, but that these two elements are separately connected to a third element, for example a housing plate. Advantageously, however, the first part of the diffusor portion and the second part of the diffusor portion are connected directly, for example by screws, such as hexagon socket screws and corresponding threads. Alternative forms of connection, such as clips, snap-in elements or the like, can also be used to achieve a detachable but stable connection.

In specific embodiments, decoupling, in particular, is carried out in such a way that it is provided at the point of separation between the first and second parts of the diffusor portion, between the motor and the impeller, in order to achieve decoupling and sealing of the two diffusor portions at the same time.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
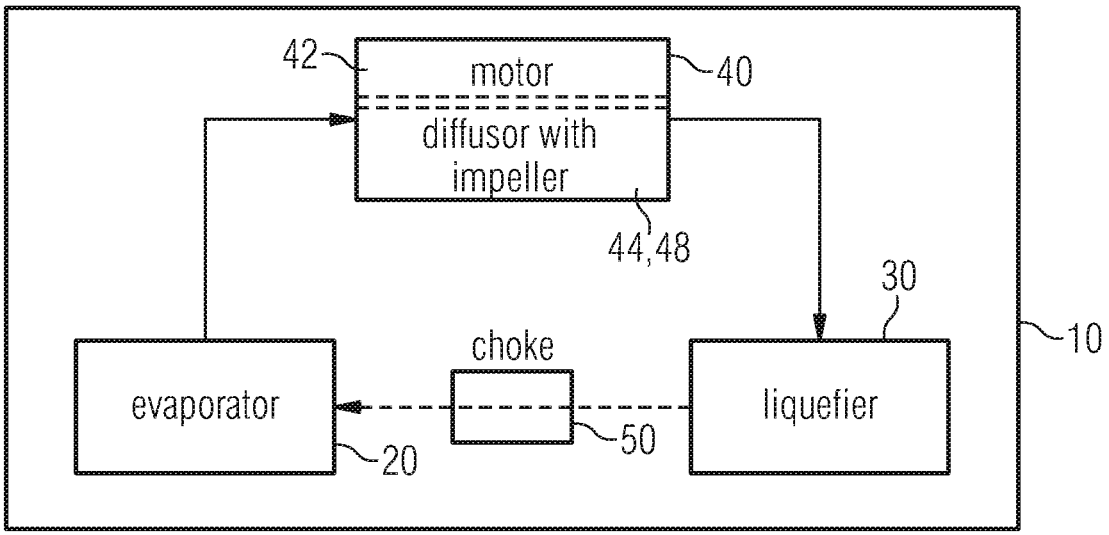
FIG. 1 shows a principle diagram of a heat pump.

FIG. 1 shows a schematic representation of a heat pump comprising a housing 10 in which an evaporator 20, a liquefier 30 and a compressor 40 are arranged. Furthermore, an optional throttle 50 is shown between the liquefier 30 and the evaporator 20 in the direction of fluid flow. The compressor 40 is located between evaporator 20 and liquefier 30 in terms of fluid flow. In particular, the compressor 40 includes a motor 42 and a diffusor 44 as well as an impeller 48.

Figure 2:
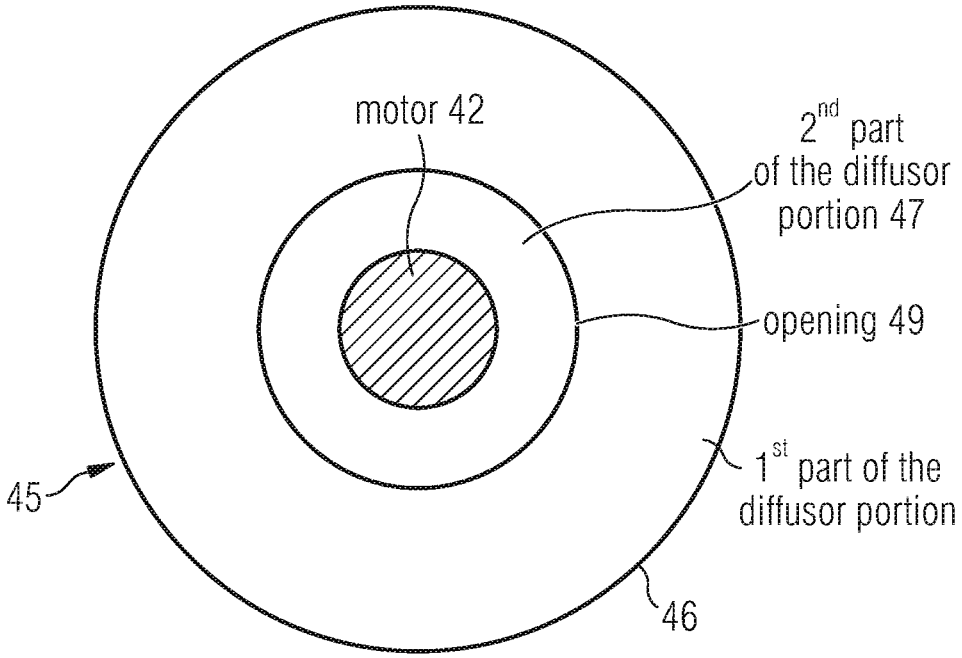
FIG. 2 shows a schematic top view of a diffusor.

The diffusor 44 comprises a diffusor portion 45, which is shown in top view in FIG. 2 and which extends between the motor 42 and the impeller 48. In particular, the diffusor portion 45 comprises a first part of the diffusor that is designated by 46 and a second part of the diffusor that is designated by 47. In particular, the first part 46 of the diffusor has an opening 49. Moreover, the second part 47 of the diffusor is configured to close the opening 49. In addition, the opening 49 is dimensioned such that the impeller 48 can be removed through the opening 49, as can be seen, for example, with reference to FIG. 3.

Figure 3:
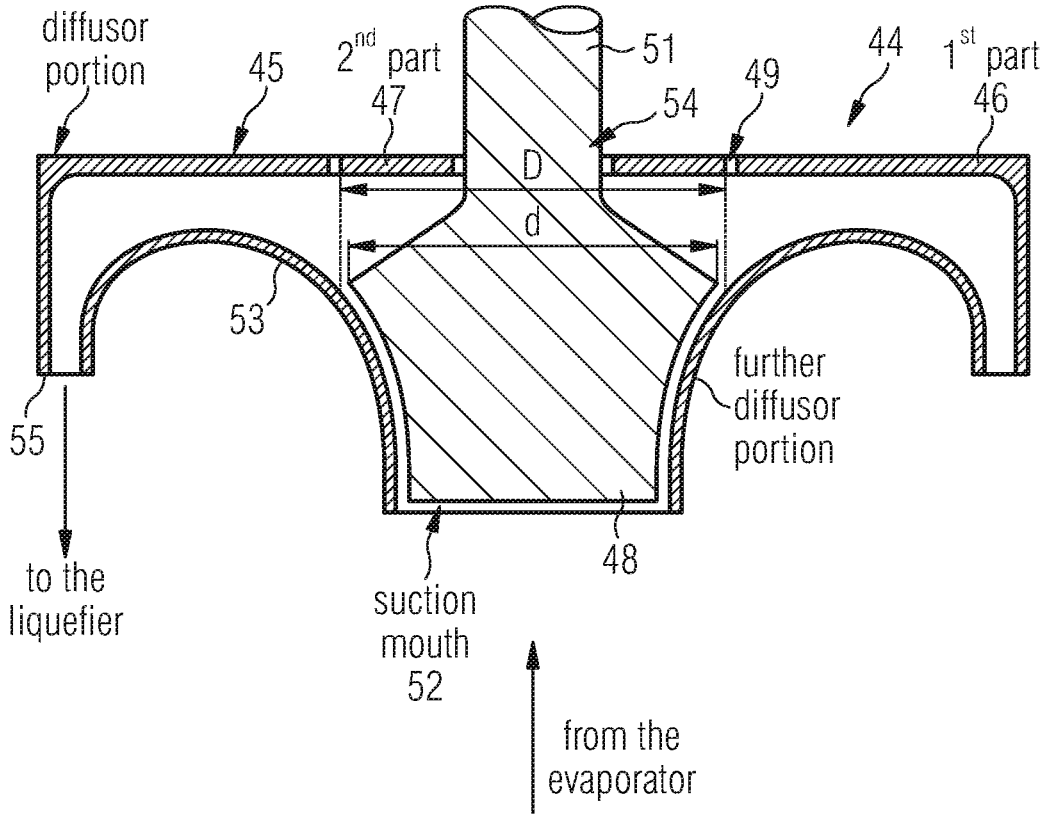
FIG. 3 shows a schematic cross-section of a diffusor.

In particular, FIG. 3 shows a cross-sectional representation, in a schematic form, of the diffusor 44, the diffusor 44 being again shown to comprise the first diffusor portion 45, which is divided into the first part 46 and the second part 47, the first part 46 comprising the opening therein which is schematically designated by 49. The diffusor further comprises a further diffusor portion 53, which in the embodiment shown in FIG. 3 is the lower part of the diffusor, while the diffusor portion 45 is the upper diffusor part 44. The diffusor 44 has the impeller 48 located therein, which is provided with a schematically shown motor axle 51 passing through an axle opening 54 and extending to the motor 42 not shown. In specific embodiments, the motor opening 54 is advantageously designed as an emergency bearing because the actual bearings for the motor shaft 51 are implemented further up near the rotor/stator combination with regard to the directions shown in FIG. 3.

Evaporated working liquid enters the diffusor from the evaporator 20 of FIG. 1, which is not shown in FIG. 3, through the suction mouth 52, is accelerated by the impeller 44 and is decelerated in that area of the diffusor which is shown to be the upper area in terms of the directions in FIG. 3, in order to convert the kinetic energy into a pressure increase or temperature increase, i.e. into internal energy. The working steam which is compressed and heated accordingly is then discharged via an outlet portion 55 of the diffusor to the liquefier, which is drawn as 30 in FIG. 1.

In FIG. 3 it is further evident that the opening 49, which is advantageously circular, is dimensioned large enough that the largest diameter extension of the diffusor, which is designated by d, is smaller than the diameter of the opening 49, which is designated by D.

Although circular orifices 49 are advantageous in certain embodiments such as those shown in FIG. 2, for example, the orifices may also have other shapes. However, a circular shape has proven to be advantageous in terms of improved sealing properties.

Figure 6:
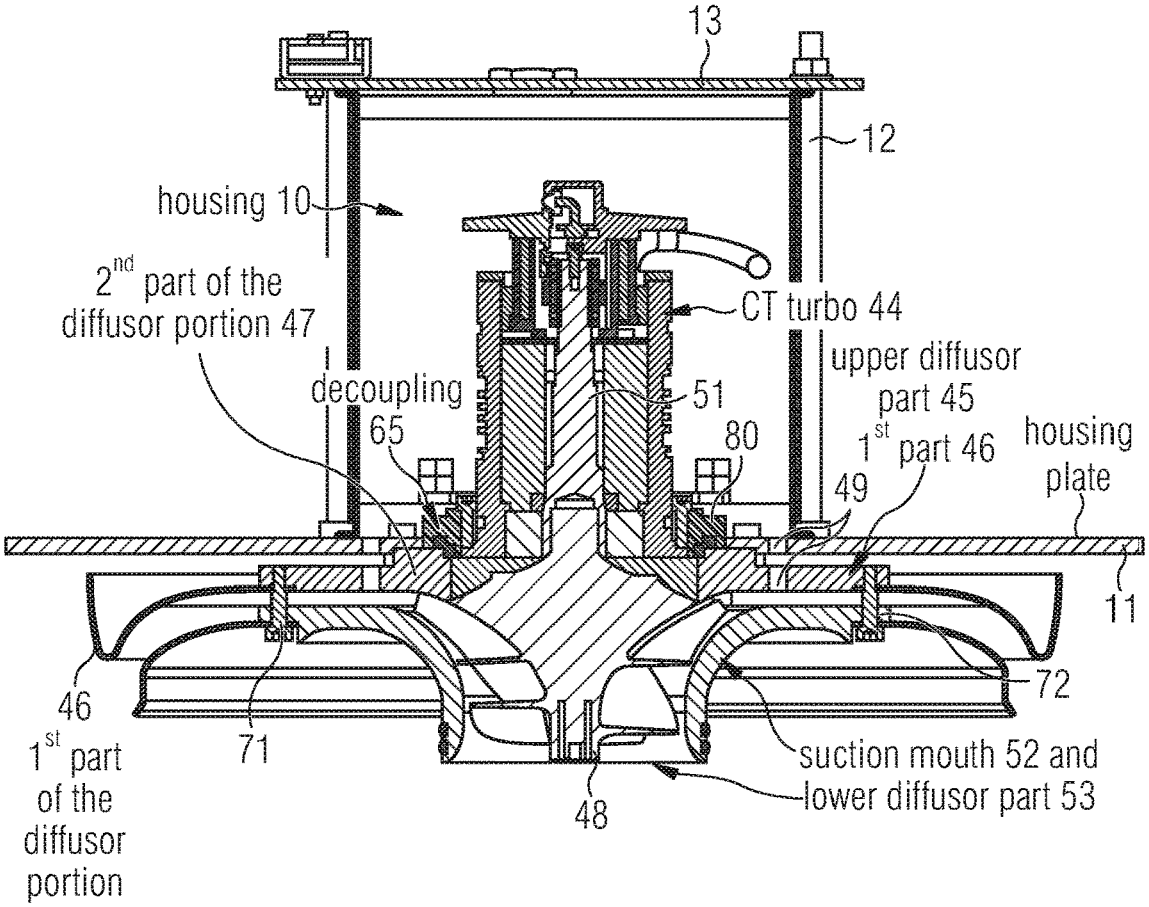
FIG. 6 shows a schematic representation of a compressor in accordance with yet another embodiment.

In the following, advantageous embodiments of the present invention will be referred to in more detail. FIG. 6 shows a cross-sectional representation of the compressor 40 comprising the motor 44, which in FIG. 6 is referred to as the "CT turbo", the motor and the motor housing itself being shown and designated as a unit bearing the reference numeral 44. The motor 44 comprises the motor shaft 51 and unspecified bearing portions in the upper part of the motor and rotor/stator elements in the middle part of the motor. The motor axle 51 is connected to the impeller 48. FIG. 6 further shows a division of the diffusor portion 45, which extends between the motor 44 and the impeller 48 and is designated as the "upper diffusor part", into the first part 46, which is not directly connected to the motor, and the second part 47, which is connected to the motor. An opening 49 is provided between the first part and the second part. The opening 49 enables the impeller 48 together with the second part 47 of the diffusor portion and the motor housing 44 located above it to be removed from the housing, of which only the housing plate 11, the upper motor housing 12 and the cover 13 are shown in FIG. 6.

Figure 8:
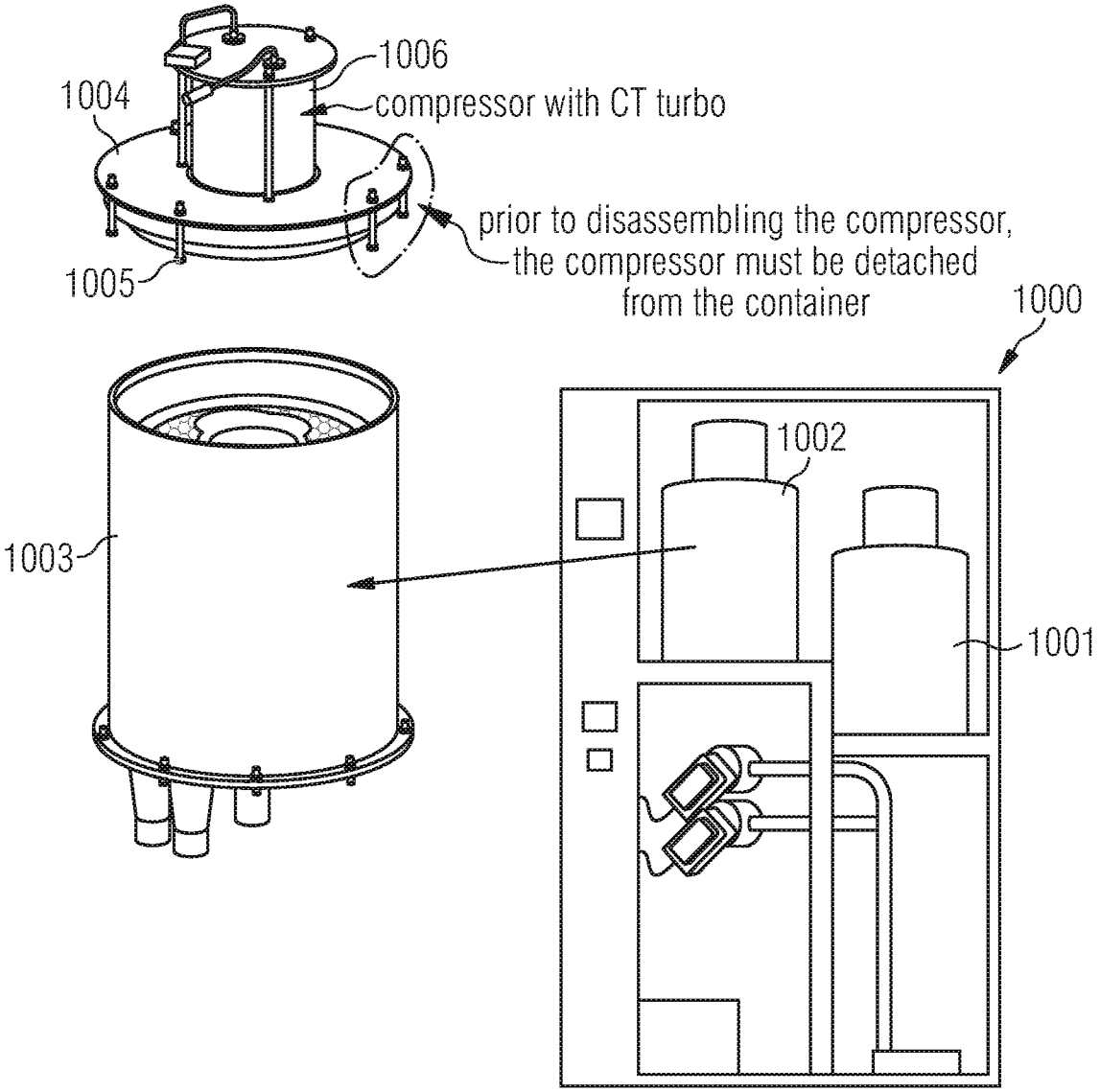
Fig. 8 (PRIOR ART)
FIG. 8 shows a representation of a known heat pump unit.

The housing plate 11 in FIG. 6 will therefore correspond, for example, to the plate 1004 of FIG. 8. In the embodiment shown in FIG. 6, this housing plate 11 extends into the housing 10 and specifically into the upper motor housing, which is formed by the elements 12 and 13 and is also part of the entire housing 10. Therefore, an opening 49 is also provided in the housing plate 11, so that the impeller can be pulled out in the upward direction once the relatively light housing element 10 has been demounted.

FIG. 6 shows the schematic arrangement of the opening 49 in the diffusor portion, in particular in the first part 46 of the diffusor portion, with more specific embodiments of this opening and the attachment between the first and second parts of the diffusor portion being shown in FIGS. 4*a* to 5*b*.

FIG. 6 also shows mechanical decoupling 65 for vibrationally decoupling the motor 44 or the motor housing from the diffusor portion 45, on the one hand, and from the housing 11, on the other hand.

The mechanical decoupling 65 is arranged in such a way that vibration of the motor is not transmitted to the upper diffusor part 45 and specifically not to the first part of the upper diffusor part and also not to the second part of the upper diffusor part, which is connected to the motor 44 and can be dismounted together with the impeller 48 without removing the entire diffusor and the entire upper housing plate 11.

The diffusor 44 is further configured, as already schematically shown in FIG. 3, to comprise the suction mouth 52 and to comprise the lower diffusor part as the further diffusor portion 53, the lower diffusor part and the upper diffusor part, which in accordance with the invention is configured in at least two parts, being connected to each other by screws 71, 72. For disassembly, only the housing cover plate 13 may be removed in the embodiment shown in FIG. 6. In the embodiment shown in FIG. 6, it is also advantageous to also loosen the decoupling 65 in order to then remove the impeller together with the second part of the upper diffusor part including the motor housing 44 via the removed cover plate 13 in the upward direction shown in FIG. 6.

In the embodiment shown in FIG. 6, the compressor 40 consists of the CT turbo assemblies, which include the compressor motor, the motor mount and the impeller wheel 48. In addition, the decoupling 65 ensures that the vibrations that occur at the CT turbo 44 are isolated from the rest of the system. In addition, FIG. 6 shows the upper diffusor part 45, the suction mouth 52 and the lower diffusor part 53. The housing 10, of which the housing plate 11, the upper region 12 of the motor housing and the cover 13 are shown in FIG. 6, serves as a point of separation from the atmosphere.

Figure 4A:
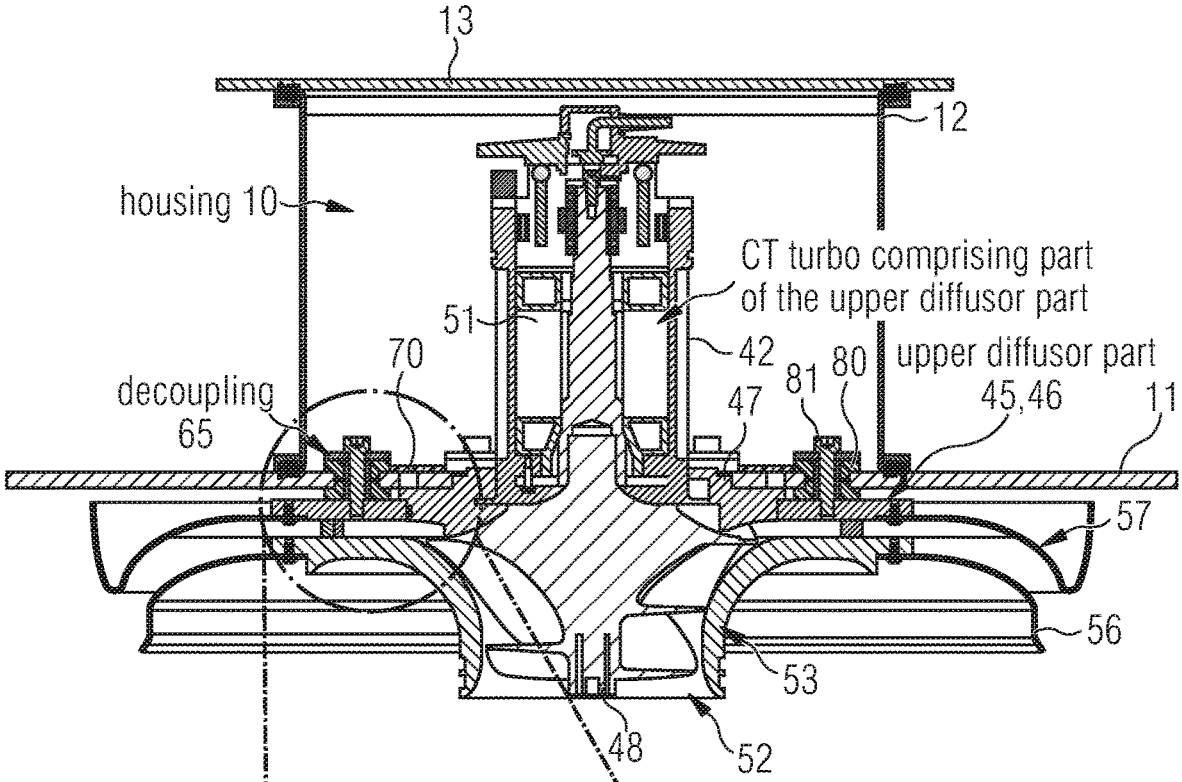
FIG. 4*a* shows a cross-section of a compressor in accordance with an embodiment.

FIG. 4*a* shows an alternative embodiment of the present invention, wherein the diffusor and in particular the upper diffusor part 45 are divided into the second diffusor part 47 and the first diffusor part 46. Between the first and the second diffusor parts, a seal 70, which is represented in the form of an O-ring in a groove, is also arranged. In particular, in the embodiment shown in FIG. 4*a*, the decoupling means 65 is provided in order to vibrationally decouple the first part 46 of the upper diffusor part 45 from the housing plate 11. An upper diffusor molding 57 is connected, e.g. by means of screws, to the first part 46 of the diffusor portion 45. Similarly, a lower diffusor molding 56 is attached, e.g. by means of screws, to the further (lower) diffusor portion, which also forms the suction mouth 52.

Figure 4E:
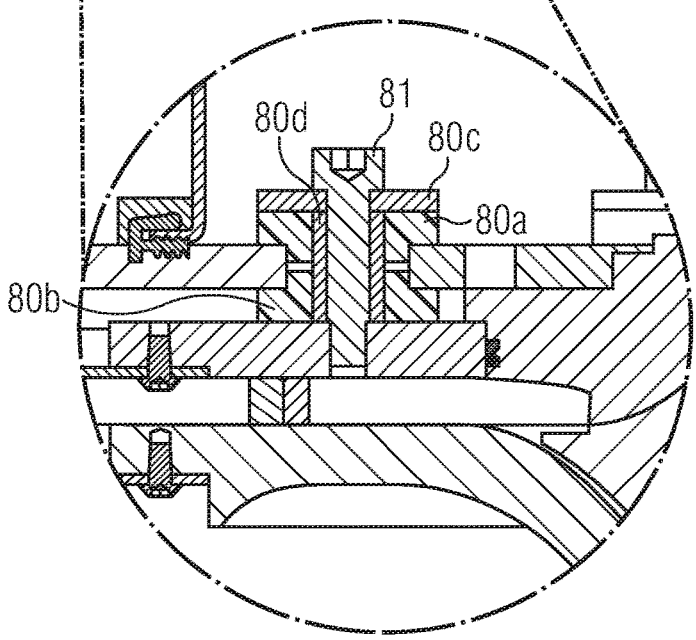
FIG. 4*e* shows a detailed representation, shown in FIG. 4*a*, of the compressor in accordance with the embodiment.
Figure 4B:
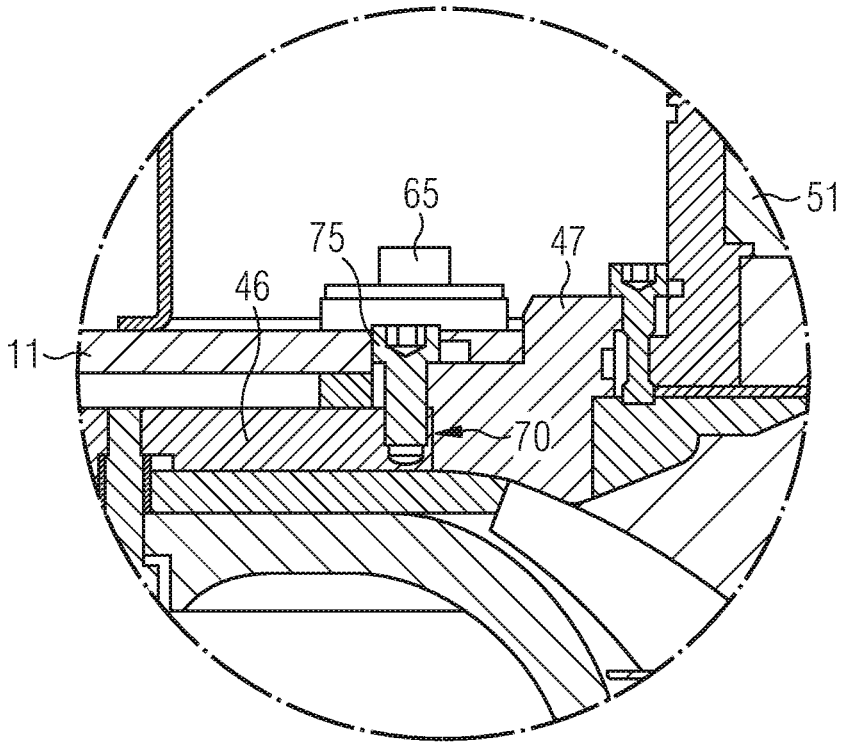
FIG. 4*b* shows a detailed representation of the compressor in accordance with the embodiment to illustrate the connection between the first part and the second part of the diffusor portion.

FIG. 4*b* shows a detailed representation of the compressor in accordance with the embodiment for illustrating the connection between the first part and the second part of the diffusor portion, this detailed representation not corresponding to the framed detail of FIG. 4*a*. This detail is shown in FIG. 4*e*. FIG. 4*b* shows a direct and advantageously rigid but detachable connection between the first part 46 of the diffusor portion and the second part 47 of the diffusor portion by means of a screw 75 extending through a bore in the second part of the diffusor portion and into a correspondingly aligned bore of the first part of the diffusor portion. By screwing in the screw 75, the first part 46 of the diffusor portion and the second part 47 of the diffusor portion are connected in a substantially rigid manner, and further sealing is provided by the seal 70 located at the interface of the second part 47 and the first part 46.

In addition, with respect to the cross-section, a decoupling 65 is shown which is located behind the fastening screw 75 and by means of which the first part 46 of the upper diffusor part 45 is vibrationally decoupled from the housing plate 11 in such a way that vibrations from the motor housing, which reach the decoupling means 65 via the first part 47 of the upper diffusor part 45, cannot reach the housing itself. In the variant of mechanical decoupling which is shown in FIG. 4*a*, the motor together with the upper diffusor part and, thus, also with the lower diffusor part carries out the same vibration, but this vibration is not transmitted to the housing and in particular to the housing plate 11 due to the attachment of the decoupling 65.

Figure 4C:
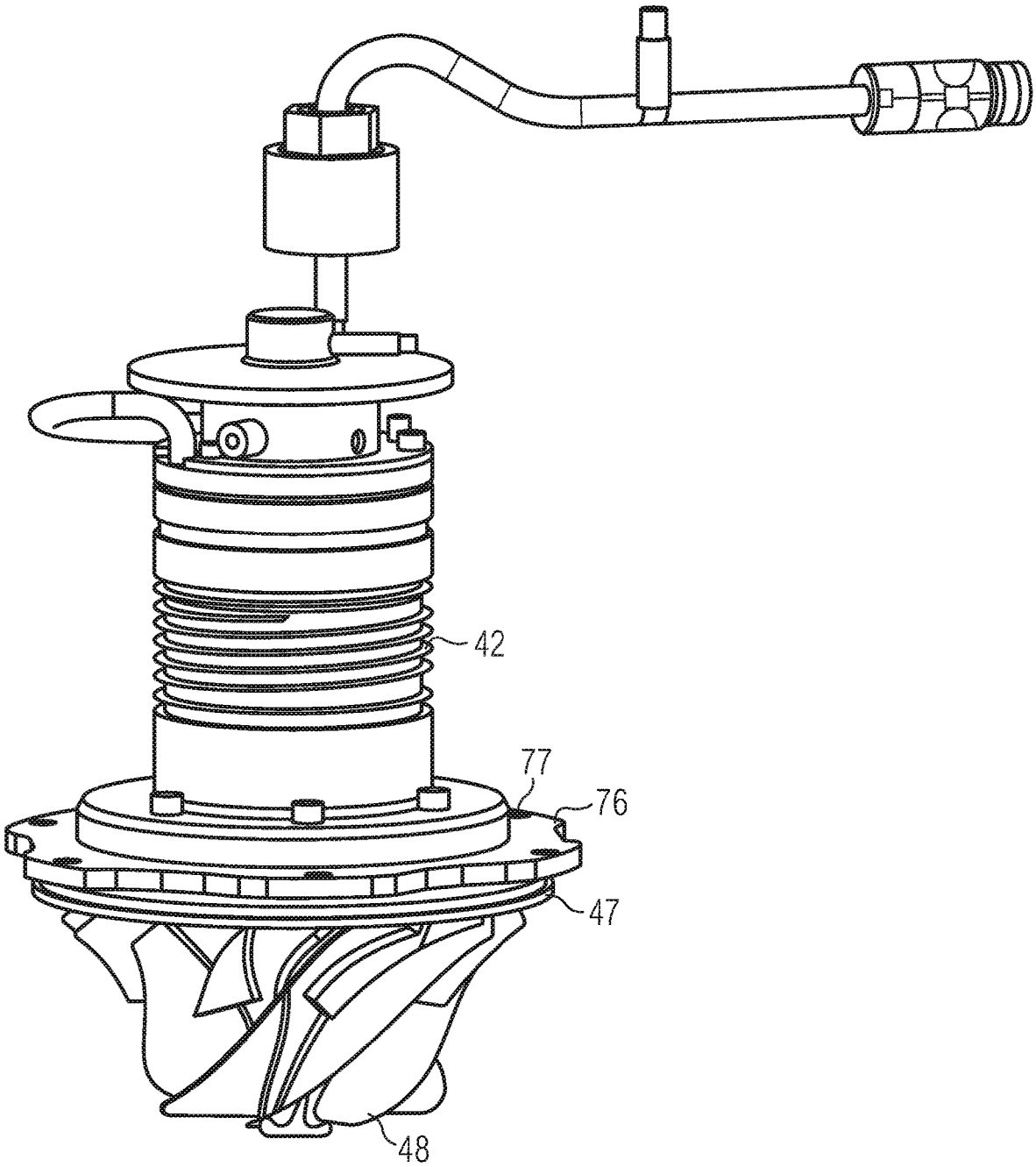
FIG. 4*c* shows a spatial representation of the dismounted motor, impeller and second part of the diffusor portion.
Figure 4D:
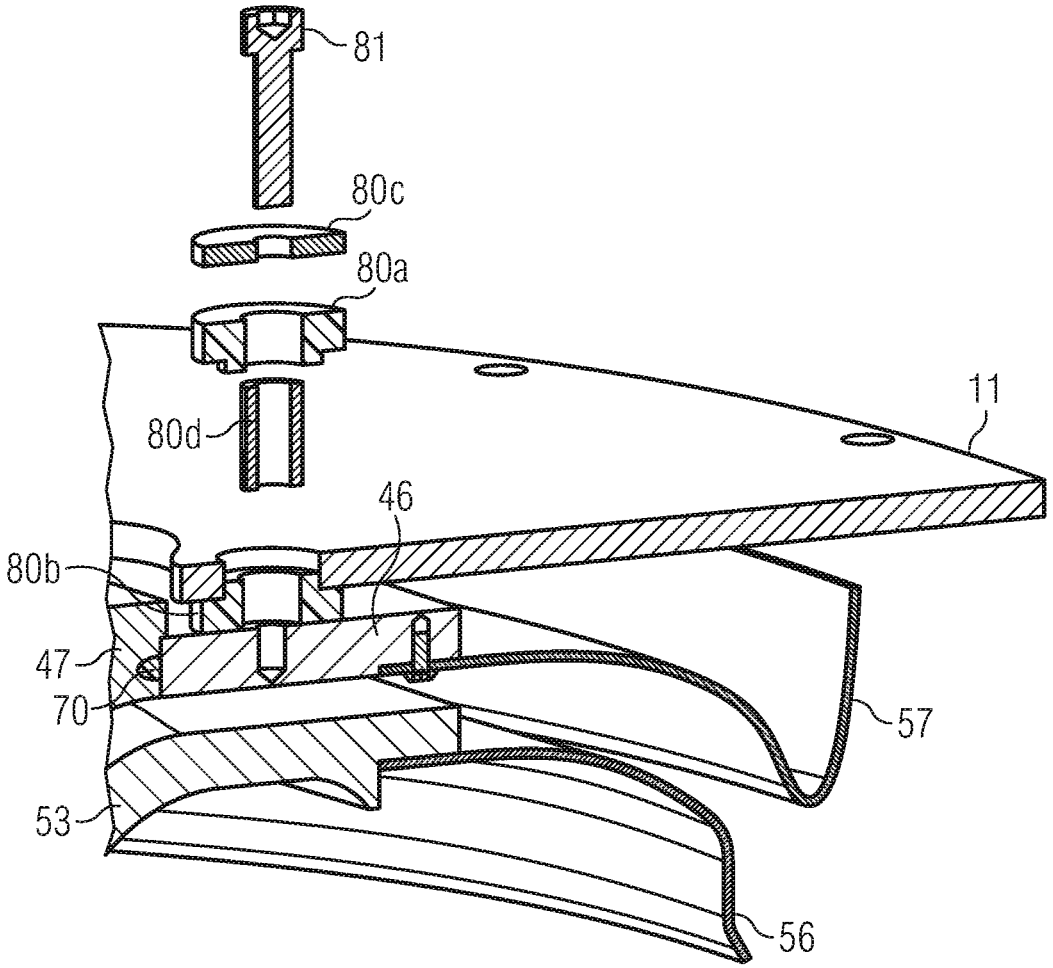
FIG. 4*d* shows an exploded view of an advantageous implementation of mechanical decoupling.

FIG. 4*e* shows the decoupling 65 of FIG. 4*a* in detail, with an exploded view being illustrated in FIG. 4*d*. The screw 81 extends, in the assembled state, through a fixed, e.g. metallic, washer 80*c*, which rests on an elastic upper ring 80*a* made of rubber, for example. A fixed, e.g. metallic, sleeve 80*d* extends through the ring, which sleeve 80*d* also has the screw 81 located therein. Further, provision is made of the lower elastic ring 80*b* made of rubber, for example, which rests on the first part 46 of the diffusor portion. The second part 47 of the diffusor portion is sealed with the first part of the diffusor portion via the O-ring 70. Thus, the first part 46 of the diffusor portion is attached to the housing plate 11 in a mechanically decoupled manner so that vibrations of the diffusor portion 46 are not transmitted to the housing. As shown in FIG. 4*b*, the second part 47 of the diffusor portion 45, which is firmly connected to the motor, as also shown in FIG. 4*c*, is firmly screwed to the first portion 46 of the diffusor portion. Thus, vibrations from the motor are transmitted to the first part 46 via this fixed screw connection, but do not reach the housing plate 11 from there due to the mechanical decoupling 81, 80*a*, 80*b*, 80*c*, 80*d*.

FIG. 4*c* shows the removed element including the motor 42, the second part 47 of the upper diffusor part 45 and the impeller 48. In addition, a fastening element 76 formed with protrusions is depicted which comprises bores 77 through which the screws 75, as shown in FIG. 4*b*, are passed to achieve fastening of the first and second parts of the diffusor portion. In addition, FIG. 4*c* shows a groove for the O-ring 70 at the intersection of the second part 47 of the upper diffusor part 45. It can be seen that the element dismounted in FIG. 4*c* is considerably smaller and therefore also considerably lighter than the entire dismounted conventional-technology element shown in FIG. 8.

In accordance with the invention, the diffusor in the embodiment shown in FIG. 4 and FIG. 5 and also FIG. 6 is divided with regard to the diffusor portion between the motor and the impeller. Furthermore, modified decoupling 65 is advantageously also carried out with regard to the decoupling 65 in FIG. 6 which is also possible. In accordance with the invention, the compressor motor 44 with a small part of the upper diffusor part, namely the element 47, can thus be removed from the entire compressor. To achieve disassembly, only the cover 13 of the housing 10 may be removed first.

Figure 5A:
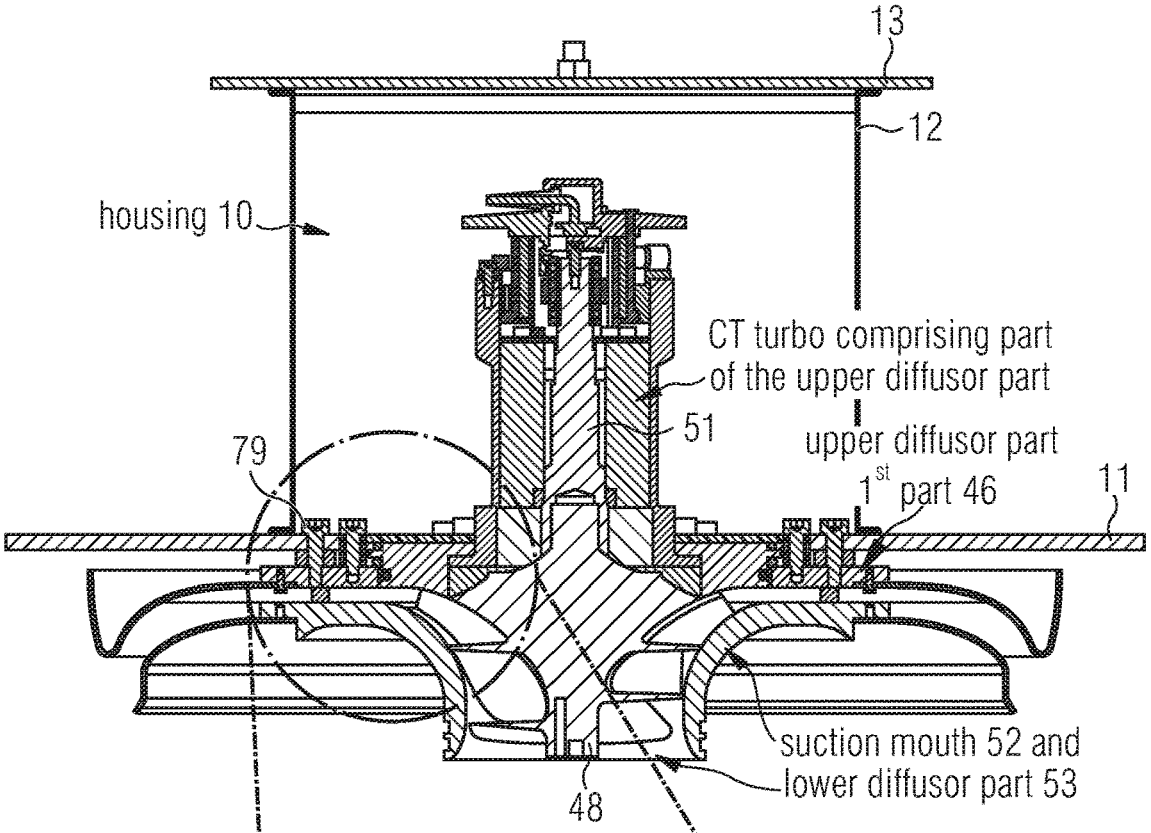
FIG. 5*a* shows a cross-sectional view of a compressor in accordance with a further embodiment.
Figure 5B:
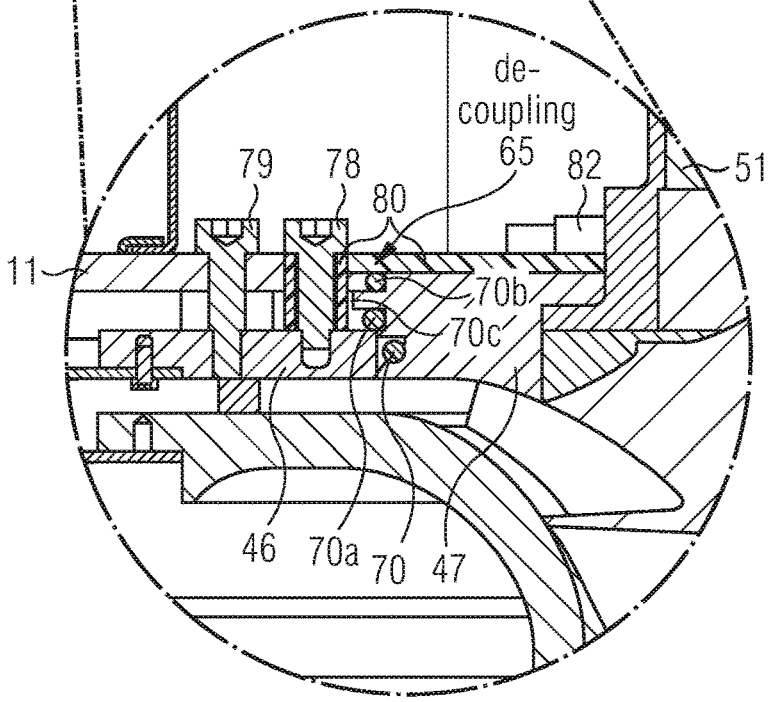
FIG. 5*b* shows a detailed representation of FIG. 5*a;*

FIGS. 5*a* and 5*b* show an alternative embodiment in which the position of the decoupling varies in comparison to FIGS. 4*a* to 4*e*. The decoupling is now integrated into the point of separation of the upper diffusor part, i.e. into the interface between the first part 46 and the second part 47 of the (upper) diffusor portion.

In particular, in the embodiment shown in FIGS. 5*a* and 5*b*, the decoupling is implemented such that a screw 48 extends within the mechanical decoupling means 65 to the first part 46. Connection of the screw 78 to the second part 47 is effected via the decoupling means 65 and is therefore not rigid. Therefore, vibration transmitted from the motor 44 to the second part 47 of the diffusor portion is not transmitted to the first part 46 of the diffusor portion but is substantially absorbed by the mechanical decoupling means 65.

FIG. 5*b* also shows an O-ring 70 for sealing and further O-rings 70*a*, 70*b* which serve to improve sealing and support mechanical vibration decoupling by the decoupling means 65. The two O-rings 70*a*, 70*b* are located above and below a tongue 70*c*, respectively, which is located at the second part 47 of the diffusor portion 45.

FIG. 5*b* and FIG. 5*a* also show a mechanically rigid connection between the housing plate 11 and the first part 46 of the diffusor portion via a schematically depicted further screw 79. In the embodiment shown in FIGS. 5*a* and 5*b*, once the lower diffusor part 53 is attached to the upper diffusor part, in particular in the first part 46 of the upper diffusor part, via individual screws, and once the upper diffusor part and in particular the first part 46 of the upper diffusor part 45 is mechanically decoupled, neither the housing nor the first part 46 of the upper diffusor part nor the lower diffusor part vibrate because of vibration present in the motor.

Figure 7A:
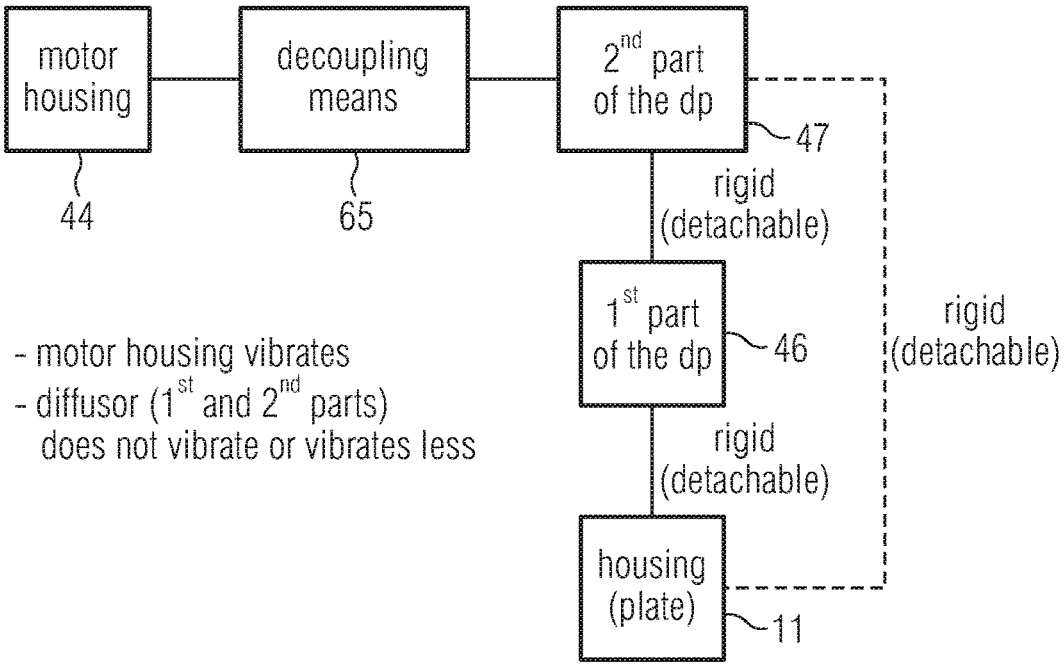
FIG. 7*a* shows a first implementation of the decoupling means.
Figure 7B:
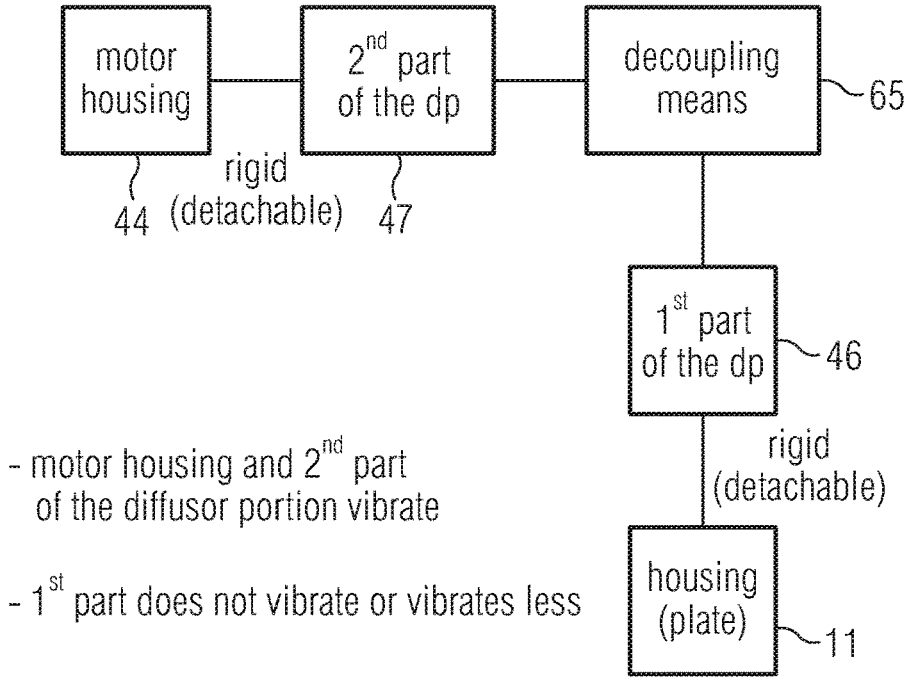
FIG. 7*b* shows a second implementation of the decoupling means.
Figure 7C:
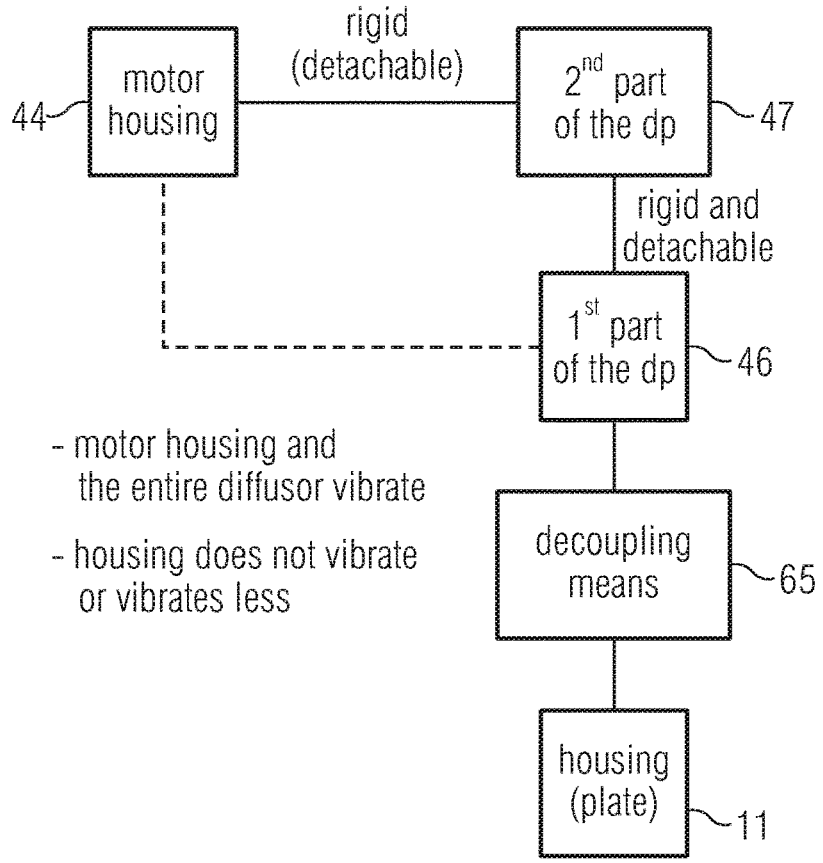
FIG. 7*c* shows a third implementation of the decoupling means.

FIGS. 7*a*, 7*b* and 7*c* show different connections of the elements of the motor housing 44, the second part 47 of the diffusor portion (dp), the first part 46 of the diffusor portion (dp), and the housing or housing plate 11. In the embodiment shown in FIG. 7*a*, the mechanical decoupling means 65 is already mounted between the motor housing 44 and the second part 47 of the diffusor portion, as also shown in FIG. 6. In this case the second part of the diffusor portion, the first part of the diffusor portion and the housing plate can then be connected to each other in an advantageously detachable but rigid manner since mechanical vibration from the motor housing 44 cannot reach other elements. In an alternative embodiment, as shown in FIG. 7*b*, the decoupling means 65 is arranged between the second part 47 of the diffusor portion and the first part 46 of the diffusor portion. This allows the second part 47 of the diffusor portion to be rigidly connected to the motor housing 44 and also allows the first part of the diffusor portion 46 to be rigidly connected to the housing plate 11. This means that only the motor housing and the second part 47 of the diffusor portion will vibrate, while the first part of the diffusor portion and, therefore, also the housing will not vibrate or vibrate less. Such an implementation, wherein the decoupling means has been mounted at the interface between the first and second diffusor portions, is illustrated in FIGS. 5*a* and 5*b*.

In another alternative shown in FIG. 7*b*, the motor housing, the second part of the diffusor portion 47 and the first part 46 of the diffusor portion are rigidly connected to each other so as to then mechanically decouple the entire diffusor from the housing 11. Such an implementation is shown in FIG. 4 and causes the motor housing and the entire diffusor to vibrate while the housing does not vibrate or vibrates less.

The implementation shown in FIG. 7*a* is advantageous in that the decoupling means is located as close as possible to the motor, i.e. at the point of vibration generation. In one implementation of the decoupling means 65, detachment of the decoupling means for disassembly may be possible. However, if the decoupling means 65 is configured in such a way that during disassembly, dismounting of the decoupling means 65 can be avoided, the embodiment shown in FIG. 7*a* is advantageous.

In the embodiment shown in FIG. 7*b*, the decoupling means is integrated into the interface between the first part 46 of the diffusor portion 45 and the second part 47 of the diffusor portion. This means that only a small part of the diffusor, namely the second part 47 of the diffusor portion 45, will vibrate along with the motor, which is not a problem, however, because this vibration takes place inside the housing and is therefore not noticeable from the outside anyway. In this implementation, both the functionality of the seal and the functionality of the decoupling can be implemented together with one and the same interface, so that a small number of parts can be achieved.

In the embodiment shown in FIG. 7*c*, the mechanical decoupling means 65 is on the housing side so that the entire diffusor will vibrate. However, this is not critical because the vibration of the diffusor takes place inside the housing. Only vibrations of the housing will disturb operation and lead to increased noise. The embodiment shown in FIG. 7*c*, as illustrated in FIG. 4*a* to FIG. 4*e*, is advantageous when the functionalities of the mechanical decoupling, on the one hand, and the sealing, on the other hand, are to be carried out separately, to the effect that during disassembly the decoupling means 65 typically does not have to be detached, which can be advantageous, as is the case in FIG. 7*a*.

The mechanical decoupling means 65 is advantageously configured in such a way that vibrationally decoupled elements are connected to one another by advantageously (hard) rubber elements. This means that a force exerted by a screw is transmitted to the corresponding element only via a rubber element, as can be seen for example in FIG. 4*a*, where rubber elements are shown at 80, which on the one hand absorb the force from a screw 81 and on the other hand transmit this force to the housing plate 11. A corresponding rubber element with nuts applied for pressure generation is also shown in FIG. 6 at 80 as mechanical decoupling. Corresponding rubber elements 80 are also shown in FIG. 5*b*; in FIG. 5*b*, the elongated rubber element 80 is again attached to the second part 47 of the diffusor via further screws 82. In this way, the force of the screw 82 is transferred to the second part 47 of the diffusor in a mechanically decoupled manner. Furthermore, the screw 78 in FIG. 5*b* connects the first part 46 of the diffusor portion to the elongated coupling element 80 and, thus, with the second part 47 of the upper diffusor part, in a mechanically decoupled manner only.

Embodiments of the present invention relate to an implementation of the heat pump in which the compressor motor is mounted on top of an evaporator/liquefier combination. In deviation from these embodiments, the impeller may also be installed in a housing from below or from the side, the same advantages being achieved here with regard to dismountability. In addition, it should be noted that the way in which the mechanical decoupling means is implemented may deviate from the rubber elements shown in the figures in order to achieve the functionalities shown in FIGS. 7*a* to 7*c* accordingly. Furthermore, the interface between the first part and the second part of the diffusor portion need not necessarily be circular, but may have any other peripheral shape. The opening 49 therefore does not necessarily have to be circular, but may have alternative shapes. In addition, seals may be used as an alternative to O-ring seals, such as rubberless labyrinth seals or similar designs, to provide sealing between the second part and the first part of the diffusor portion 45 between the motor and the impeller.

The present invention provides specific advantages in its specific embodiments, which are that typically only a single service technician is needed to change the CT turbo, i.e. the compressor. Furthermore, no lifting tools are required for changing the compressor motor. Handling and, thus, dismountability and mountability of the entire heat pump are made considerably more efficient, as the smaller size and lower weight result in a number of simplifications. In addition, transport costs are also reduced due to the smaller size and lower weight.

The present invention further concerns a method of manufacturing a heat pump or a method of dismounting or mounting a heat pump. To manufacture a heat pump, a liquefier and an evaporator are arranged in a housing. Further, a compressor is arranged between the evaporator and the condenser in terms of fluid flow, the compressor comprising a motor, an impeller connected to the motor, and a diffusor. Further, the diffusor is manufactured such that the diffusor portion extending between the motor and the impeller comprises at least two parts, a first part of the diffusor portion being connected to the housing and a second part of the diffusor portion being connected to the motor. In particular, the first part of the diffusor portion has an opening. The second part of the diffusor portion is configured to close the opening, and the opening is dimensioned such that the impeller can be removed from the housing through the opening and may thus also be inserted into the housing.

In a method of dismounting or mounting the heat pump, the housing is first opened. Then a connection between the second part of the diffusor portion and the first part of the diffusor portion is released, and then the impeller, the second part of the diffusor portion and the motor are removed from the housing. During mounting, the impeller is inserted through the opening, whereupon the second part is connected to the first part of the diffusor portion, and the housing is closed.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A heat pump comprising:

a housing;

a liquefier and an evaporator arranged inside the housing; and a compressor disposed between the evaporator and the liquefier in terms of fluid flow, the compressor comprising a motor, an impeller connected to the motor, and a diffusor, wherein the diffusor comprises a diffusor portion extending between the motor and the impeller, the diffusor portion comprising at least two parts, a first part of the diffusor portion being connected to the housing and a second part of the diffusor portion being connected to the motor, and wherein the first part of the diffusor portion comprises an opening, wherein the second part of the diffusor portion is configured to close the opening, and wherein the opening is dimensioned such that the impeller is removable from the housing through the opening.

2. The heat pump as claimed in claim 1, wherein the first part of the diffusor portion and the second part of the diffusor portion are connected by means of a releasable connection, the releasable connection being a direct connection, such that the first part of the diffusor portion is connected to the second part of the diffusor portion via a plurality of screws.

3. The heat pump as claimed in claim 1, in which the first part of the diffusor portion is connected to the housing via a mechanical decoupler in such a way that mechanical vibration of the second part of the diffusor portion is at least partially damped by the mechanical decoupler.

4. The heat pump as claimed in claim 1, wherein an elastic seal is arranged between the first part of the diffusor portion and the second part, or wherein the second part of the diffusor portion is not or only flexibly connected to the housing so that a relative movement between the second part of the diffusor portion and the housing is possible.

5. The heat pump as claimed in claim 1, wherein the first part of the diffusor portion is rigidly connected to the housing and the second part of the diffusor portion is connected to the first part of the diffusor portion via a mechanical decoupler, so that vibration of the second part of the diffusor portion is damped or is transmissible to the housing or to the first part of the diffusor portion at least in a reduced manner.

6. The heat pump as claimed in claim 5, wherein at least two O-ring seals are arranged between the first part of the diffusor portion and the second part of the diffusor portion, or wherein the mechanical decoupler is configured to allow relative movement of the second part of the diffusor portion with respect to the first part of the diffusor portion in at least two degrees of freedom.

7. The heat pump as claimed in claim 5, wherein the mechanical decoupler is configured to enable decoupling both between the second and first parts of the diffusor portion and between the second part of the diffusor portion and the housing.

8. The heat pump as claimed in claim 1, wherein a mechanical decoupler comprises a rubber element and a screw, so that a force transmission between a respective element takes place via the rubber element.

9. The heat pump as claimed in claim 1, wherein the second part of the diffusor portion comprises, in a top view, a circumferential line which comprises projecting regions and indentations between each two projecting regions or which is circular, bores being formed in the projecting regions or on a circumference, wherein the opening of the first part of the diffusor portion is substantially circular, the first part of the diffusor portion comprising bores at locations which coincide with the bores of the second part of the diffusor portion, wherein the first part and the second part of the diffusor portion are connected by screws within the coinciding bores.

10. The heat pump as claimed in claim 1, wherein the second part of the diffusor portion comprises a region comprising a circular circumferential line and comprising a groove and an O-ring inside the groove, the first part of the diffusor portion engaging with the region comprising the circular circumferential line of the second part of the diffusor portion and the O-ring in the assembled state.

11. The heat pump as claimed in claim 1, wherein the second part of the diffusor portion comprises the following features:

a first circular region comprising a first circumference with a groove inside of which an O-ring can be mounted, a second region comprising a second circumference formed as a circumferential tongue, and a third region comprising a third circumference smaller than the second circumference, wherein O-rings are insertable on both sides of the tongue of the second region, wherein the O-ring inside the groove and an O-ring on one side of the tongue engage the first part of the diffusor portion in an assembled state and wherein the O-ring on the other side of the tongue engages a portion of a mechanical decoupler.

12. The heat pump as claimed in claim 1, comprising a mechanical decoupler, the mechanical decoupler being configured to perform vibratory decoupling of the motor from the second part of the diffusor portion, or perform vibratory decoupling of the first part of the diffusor portion from the second part of the diffusor portion, or perform vibratory decoupling of the diffusor portion from the housing.

13. The heat pump as claimed in claim 12, wherein the first part of the diffusor portion and the second part of the diffusor portion are mechanically connected in a rigid and detachable manner, and the mechanical decoupler is configured to vibrationally decouple the motor from the second part of the diffusor portion or to vibrationally decouple the diffusor portion from the housing, or wherein the housing and the second part of the diffusor portion are mechanically connected in a rigid manner, and the mechanical decoupler is configured to vibrationally decouple the first part of the diffusor portion from the second part of the diffusor portion.

14. The heat pump as claimed in claim 1, wherein a fluid seal is arranged between the first part and the second part of the diffusor portion, the fluid seal being configured to seal an inner region of the diffusor from an outer region of the diffusor in the assembled state.

15. The heat pump as claimed in claim 1, wherein the compressor further comprises a suction mouth, the suction mouth being arranged to suck gaseous fluid from the evaporator due to rotation of the impeller and to conduct it to the diffusor, and the diffusor being configured to conduct compressed gaseous fluid into the liquefier via a diffusor outlet, the suction mouth being connected to the diffusor.

16. The heat pump as claimed in claim 1, wherein the diffusor comprises a further diffusor portion in addition to the diffusor portion, the diffusor portion and the further diffusor portion being detachably connected, and the further diffusor portion being arranged between the liquefier and the diffusor portion.

17. The heat pump as claimed in claim 1, wherein in the direction of operation, the housing comprises a lower region with a first cross-portion, the evaporator, the liquefier, the impeller and the diffusor being arranged in the lower region, wherein the housing comprises an upper region with a second cross-portion which is smaller than the first cross-portion, the motor being arranged in the upper region, wherein the housing comprises a housing plate which delimits the lower region in the upward direction and extends into the upper region, and wherein the housing plate comprises a plate opening which is at least large enough so that the impeller is removable from the lower region through the plate opening in the direction of the upper region.

18. A method of manufacturing a heat pump comprising a housing; a liquefier and an evaporator arranged inside the housing; a compressor interposed between the evaporator and the liquefier in terms of fluid flow, the compressor comprising a motor, an impeller connected to the motor, and a diffusor comprising a diffusor portion extending between the motor and the impeller, comprising:

forming the diffusor portion into at least two parts; and connecting a first part of the diffusor portion to the housing and a second part of the diffusor portion to the motor, wherein the first part of the diffusor portion comprises an opening, wherein the second part of the diffusor portion is configured to close the opening, and wherein the opening is dimensioned such that the impeller is removable from the housing through the opening.

19. A method of disassembling or assembling a heat pump comprising a housing; a liquefier and an evaporator disposed inside the housing; a compressor interposed between the evaporator and the liquefier in terms of fluid flow, the compressor comprising a motor, an impeller connected to the motor, and a diffusor, the diffusor comprising a diffusor portion extending between the motor and the impeller, wherein the diffusor portion comprises at least two parts, a first part of the diffusor portion being connected to the housing and a second part of the diffusor portion being connected to the motor, and wherein the first part of the diffusor portion comprises an opening, and wherein the second part of the diffusor portion is configured to close the opening; comprising:

opening the housing; detaching the first part of the diffusor portion from the second part of the diffusor portion; and removing the impeller through the opening in the first part of the diffusor portion, the impeller being attached to the second part of the diffusor portion, and the second part of the diffusor portion being attached to the motor; and removing the motor, the second part of the diffusor portion and the impeller from the housing; or inserting the impeller through the opening, the impeller being attached to the second part of the diffusor portion, and the second part of the diffusor portion being attached to the motor; attaching the first part of the diffusor portion to the second part of the diffusor portion; and closing the housing, the motor being housed inside the housing.

* * * * *